US008443977B2

(12) United States Patent
Killinger et al.

(10) Patent No.: US 8,443,977 B2
(45) Date of Patent: May 21, 2013

(54) BLISTER PACKAGE APPARATUS AND METHODS FOR TABLETS

(75) Inventors: Fred M. Killinger, Cary, NC (US); Christopher A. Mills, Raleigh, NC (US); Vincent P. Pisculli, Jr., Raleigh, NC (US)

(73) Assignee: GSK LLC, Philadelphia, PA (US)

( * ) Notice: Subject to any disclaimer, the term of this patent is extended or adjusted under 35 U.S.C. 154(b) by 194 days.

(21) Appl. No.: 12/995,689

(22) PCT Filed: Jun. 26, 2009

(86) PCT No.: PCT/US2009/048751

§ 371 (c)(1),
(2), (4) Date: Dec. 2, 2010

(87) PCT Pub. No.: WO2010/002716

PCT Pub. Date: Jan. 7, 2010

(65) Prior Publication Data

US 2011/0079530 A1 Apr. 7, 2011

Related U.S. Application Data

(60) Provisional application No. 61/076,935, filed on Jun. 30, 2008.

(51) Int. Cl.
*B65D 75/327* (2006.01)
*B65D 83/0463* (2006.01)
*B65D 2585/56* (2006.01)

(52) U.S. Cl.
USPC ..... 206/532; 206/538; 206/531

(58) Field of Classification Search
USPC ..... 206/531, 538, 528, 535, 532, 505, 206/828, 704, 534, 462
See application file for complete search history.

(56) References Cited

U.S. PATENT DOCUMENTS

| | | | | | |
|---|---|---|---|---|---|
| 3,246,746 | A * | 4/1966 | Danforth | 206/462 |
| 3,737,029 | A * | 6/1973 | Serrell et al. | 206/461 |
| 4,192,422 | A | 3/1980 | Kotyuk | |
| 4,537,312 | A * | 8/1985 | Intini | 206/531 |
| 4,911,304 | A * | 3/1990 | Bunin | 206/531 |
| D320,930 | S * | 10/1991 | Richards | D9/732 |
| D387,977 | S * | 12/1997 | Kallgren | D9/732 |
| 5,894,930 | A * | 4/1999 | Faughey et al. | 206/532 |
| 6,253,920 | B1 * | 7/2001 | Kallgren | 206/532 |
| 6,874,636 | B2 * | 4/2005 | Paliotta et al. | 206/531 |
| D580,788 | S * | 11/2008 | Scholefield | D9/756 |
| 7,780,009 | B2 * | 8/2010 | Casanova | 206/705 |
| 2005/0284785 | A1 | 12/2005 | Manoucherians | |

(Continued)

*Primary Examiner* — Steven A. Reynolds
(74) *Attorney, Agent, or Firm* — Robert J. Smith

(57) ABSTRACT

Disclosed are blister package apparatuses and methods for use with tablets such as soft or breakable tablets that cannot be forced through a push-through layer. Specifically, a package for soft tablets can include a pair of blister strips, each blister strip having a plastic sheet, a plurality of recesses formed in the plastic sheet, and a peel-away backing layer for covering the recesses. A plurality of support posts can secure the blister strips together, and a spacer element can extend from one of the blister strips towards the other blister strip, the spacer element extending between two or more of the recesses for maintaining the blister strips in a spaced-apart configuration. The plurality of recesses formed in each blister strip can be offset with respect to the recesses formed in the other blister strip such that the recesses of one blister strip can nest between the recesses of the other.

23 Claims, 9 Drawing Sheets

U.S. PATENT DOCUMENTS

2006/0289328 A1 12/2006 Hession
2007/0045147 A1* 3/2007 Baker et al. ..... 206/531
2009/0184023 A1* 7/2009 Brollier et al. ..... 206/531

* cited by examiner

BLISTER PACKAGE APPARATUS AND METHODS FOR TABLETS

CROSS-REFERENCE TO RELATED APPLICATIONS

This application is filed pursuant to 35 U.S.C. §371 as a United States National Phase Application of International Application No. PCT/US2009/048751 filed Jun. 26, 2009, which claims priority from U.S. Provisional Application No. 61/076,935 filed Jun. 30, 2008.

TECHNICAL FIELD

The present disclosure relates to blister packages for use with pills, tablets, capsules, or other small objects. More specifically, the present disclosure relates to blister package apparatuses and methods for use with tablets such as soft or breakable tablets that cannot be forced through a push-through layer.

BACKGROUND

Medications or vitamins in pill, tablet, or capsule form are often packaged, stored, and distributed to consumers in plastic sheets generally called blister packages. These blister packages often have each dose of the product sealed within a separate pocket or blister, thereby isolating the individual doses from each other and from environmental contaminants. Many designs for blister packages currently in use involve a push-through opening mechanism. In these designs, a thin layer of plastic, foil, or other rupturable material is secured to the package over the individual blisters to secure the doses within the package until they are extracted by the consumer. Extraction of the product sealed within the blister package often involves pushing against the backside of the blister to force the product against the rupturable layer. If this force is sufficient to break the rupturable layer, the dose is ejected through the layer and is thus made available to the consumer. The ability to dispense individual doses of the product while keeping the remaining doses securely stored has made the use of these blister packages increasingly popular.

Of course, not all kinds of medications and vitamins can be distributed using this kind of push-through packaging design. In particular, some kinds of medications and vitamins are soft, breakable, or otherwise ill-suited for an extraction process in which a substantial force is applied to the medication or vitamin itself. Unfortunately, the use of the push-through kind of blister packages has become so widespread that consumers tend to assume that blister packs are meant to be opened by applying pressure against the blister pocket associated with a dose of the product. Applying such pressure to a package containing a soft or breakable product, however, can result in the product being crushed, broken, or otherwise damaged while the consumer tries to retrieve it from the package. As a result, special care must be taken when designing a blister package for distributing soft or breakable medications and vitamins to prevent consumers from inadvertently destroying the product contained in the package.

SUMMARY

The subject matter disclosed herein relates to blister package apparatuses and methods for use with tablets such as soft or breakable tablets that cannot be forced through a push-through layer.

Accordingly, in a first aspect, the subject matter disclosed herein provides a package for soft tablets. The package can include a first blister strip and a second blister strip. Each of the blister strips can have a plastic sheet having a first surface and an opposing second surface, a plurality of recesses formed in the plastic sheet and projecting from the first surface, and a backing layer secured to the second surface for covering the plurality of recesses. Each of the recesses can be adapted to receive a soft tablet. Further, the package can include a plurality of support posts fixedly securing the first blister strip to the second blister strip to form a package and a spacer element that can extend from one of the first blister strip or the second blister strip towards the other of the first blister strip or the second blister strip. The spacer element can extend between two or more of the plurality of recesses for maintaining the blister strips in a spaced-apart configuration. The plurality of recesses formed in the second blister strip can be offset with respect to the recesses formed in the first blister strip, wherein the recesses of the second blister strip nest between the recesses of the first blister strip.

In another aspect, the subject matter disclosed herein provides a package for soft tablets. The package can include a first blister strip, the first blister strip having a plastic sheet having a first surface and an opposing second surface, a plurality of recesses projecting from the first surface, a backing layer on the second surface and covering the plurality of recesses, a first raised feature on the first surface extending between two or more of the plurality of recesses, a second raised feature on the first surface at one end of the blister strip, and a plurality of support posts spaced about the first surface.

In addition, the package can include a second blister strip positioned facing the first blister strip. The second blister strip can include a plastic sheet having a first surface and an opposing second surface, the first surface facing the first surface of the first blister strip. A plurality of recesses can project from the first surface, the recesses arranged on the first surface such that they are offset from the plurality of recesses of the first blister strip. A backing layer can be provided on the second surface covering the plurality of recesses. The second blister strip can further include a first raised feature on the first surface extending between two or more of the plurality of recesses, the first raised feature being substantially aligned with the first raised feature of the first blister strip to form a first spacer section. A second raised feature can be provided on the first surface at one end of the blister strip, the second raised feature being substantially aligned with the second raised feature of the first blister strip to form a second spacer section. Finally, a plurality of support posts can be spaced about the first surface and secured to the plurality of support posts of the first blister strip. Each of the recesses in both the first blister strip and the second blister strip can be adapted to receive a soft tablet.

In yet another aspect, the subject matter disclosed herein provides a method for distributing a soft tablet. The method can include providing a package for soft tablets, the package comprising a first blister strip and a second blister strip, each of the blister strips having a plastic sheet having a first surface and an opposing second surface, a plurality of recesses formed in the plastic sheet and projecting from the first surface, and a backing layer secured to the second surface for covering the plurality of recesses. The plurality of recesses formed in the second blister strip can be offset with respect to and nesting between the recesses formed in the first blister strip, and each of the recesses can be adapted to receive a soft tablet. The backing layer can include score lines about each of the plurality of recesses, the score lines define an access panel, and at least an unsecured portion of the access panel that is not secured to the second surface can define a pull tab. A plurality of support posts can fixedly secure the first blister strip to the second blister strip, and a spacer element can extend from one of the first blister strip or the second blister strip towards the other of the first blister strip or the second blister strip, the spacer element extending between two or more of the plurality of recesses for maintaining the blister strips in a spaced-apart configuration. Further, the method can include lifting a pull tab of one of first or second blister strips and pulling an access panel corresponding to the pull tab away from the plastic sheet to reveal one of the soft tablets within a recess. Finally, the soft tablet can be removed from the recess.

BRIEF DESCRIPTION OF THE DRAWINGS

Specific embodiments of the subject matter disclosed herein will now be described in more detail, by way of example, with reference to the accompanying drawings, in which.

DETAILED DESCRIPTION

Reference will now be made in detail to possible embodiments of the present subject matter, one or more examples of which are shown in the figures. Each example is provided to explain the subject matter and not as a limitation. In fact, features illustrated or described as part of one embodiment can be used in another embodiment to yield still a further embodiment. It is intended that the subject matter disclosed herein cover such modifications and variations.

Figure 1:
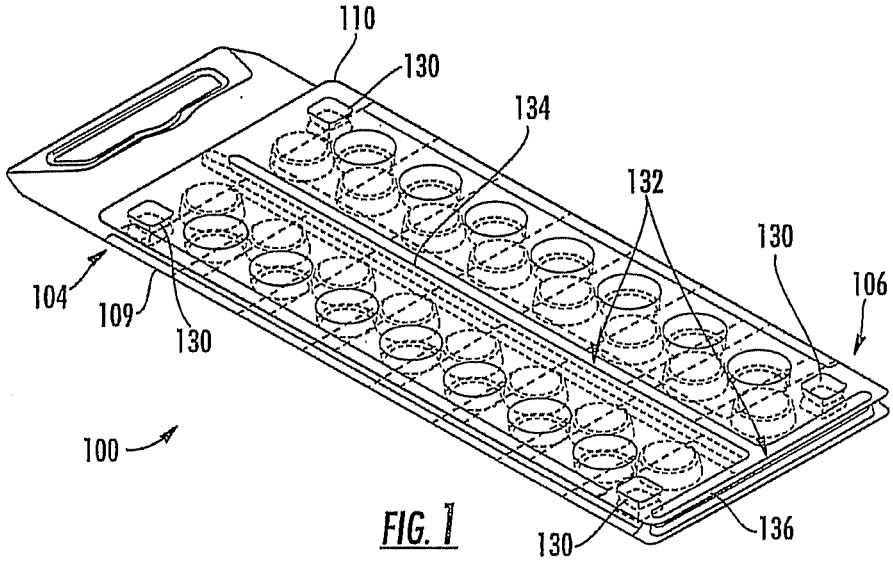
FIG. 1 shows a perspective view of two blister strips secured together with the individual blisters of the blister strips nested together according to one embodiment of the subject matter disclosed herein.
Figure 2:
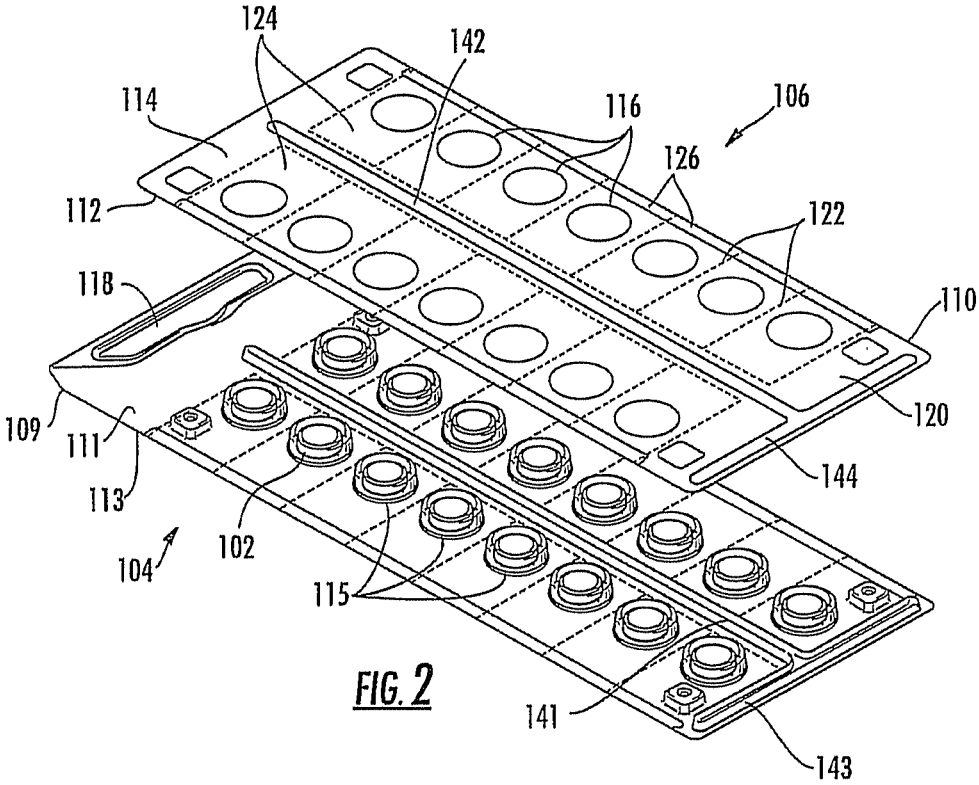
FIG. 2 shows a perspective view of the two blister strips illustrated in FIG. 1 separated from each other.

According to one aspect of the subject matter disclosed herein, FIGS. 1 and 2 illustrate generally a package 100 designed to be used for the storage and distribution of tablets such as tablets 102, which can be any suitable tablets such as, for example and without limitation, tablets that are soft or breakable and include doses of a medicament or vitamin.

The term "medicament", as used herein, is meant to mean and include any substance (i.e., compound or composition of matter) which, when administered to an organism (human or animal) induces a desired pharmacologic and/or physiologic effect by local and/or systemic action. The term therefore encompasses substances traditionally regarded as actives, drugs and bioactive agents, as well as biopharmaceuticals (e.g., peptides, hormones, nucleic acids, gene constructs, etc.) typically employed to treat a number of conditions which is defined broadly to encompass diseases, disorders, infections, and the like. Exemplary medicaments include, without limitation, antibiotics, antivirals, $H_2$-receptor antagonists, $5HT_1$ agonists, $5HT_3$ antagonists, COX2-inhibitors, medicaments used in treating psychiatric conditions such as depression, anxiety, bipolar condition, tranquilizers, medicaments used in treating metabolic conditions, anticancer medicaments, medicaments used in treating neurological conditions such as epilepsy and Parkinsons Disease, medicaments used in treating cardiovascular conditions, non-steroidal anti-inflammatory medicaments, medicaments used in treating Central Nervous System conditions, and medicaments employed in treating hepatitis. One example of a specific medicament is lamotrigine.

The term medicament also encompasses pharmaceutically acceptable salts, esters, solvates, and/or hydrates of the pharmaceutically active substances referred to hereinabove. Various combinations of any of the above medicaments may also be employed.

In accordance with the present invention, the medicament is typically employed in an oral pharmaceutical formulation, in one embodiment, a soft tablet. An oral pharmaceutical formulation typically refers to the combination of at least one medicament and one or more added components or elements, such as an "excipient" or "carrier." As will be appreciated by one having ordinary skill in the art, the terms "excipient" and "carrier" generally refer to substantially inert materials that are nontoxic and do not interact with other components of the composition in a deleterious manner. Examples of normally employed "excipients," include pharmaceutical grades of carbohydrates, including monosaccharides, disaccharides, povidone, cyclodextrins and polysaccharides (e.g., dextrose, sucrose, lactose, raffinose, mannitol, sorbitol, inositol, dextrins and maltodextrins); starch; cellulose (e.g., microcrystalline cellulose); salts (e.g., sodium or calcium phosphates, calcium sulfate, magnesium sulfate); citric acid; tartaric acid; glycine; leucine; high molecular weight polyethylene glyols (PEG); pluronics; surfactants; lubricants; stearates and their salts or esters (e.g., magnesium stearate); amino acids; fatty acids; and combinations thereof.

In one embodiment the packaging of the invention is employed with a tablet containing the medicament lamotrigine. Lamotrigine is described and its preparation is disclosed in U.S. Pat. No. 4,602,017, which is incorporated in its entirety herein by reference. Lamotrigine is chemically 3,5-diamino-6-(2,3-dichlorophenyl)-1,2,4-triazine). It has the empirical formula of $C_9H_7N_5Cl_2$, a molecular weight of 256.09 and the structural formula shown below:

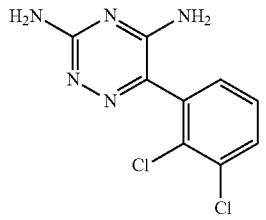

Lamotrigine is an anticonvulsant drug used in the treatment of epilepsy and bipolar disorder, and is used to treat partial seizures, primary and secondary tonic-clonic seizures, and seizures associated with Lennox-Gastaut syndrome.

Preferably, the lamotrigine tablet is a soft tablet. An example of such a soft tablet is an orally dispersing or orally disintegrating tablet (ODT) composition comprising a therapeutically effective amount of lamotrigine, wherein after administration the composition substantially disintegrates in the oral cavity (e.g., mouth) of a patient and provides a lamotrigine release profile which is substantially the same as the lamotrigine release profile of an immediate release lamotrigine composition. Such a composition is described, for example, in U.S. provisional application 60/929,536 filed 2 Jul. 2007 and incorporated herein by reference in its entirety. As used herein, the terms "orally dispersing tablet", "orally disintegrating tablet", or "ODT" refer to a solid dosage form of the tablet which disintegrates rapidly in the oral cavity of a patient after administration, typically in the absence of chewing. The rate of disintegration can vary, but is faster than the rate of disintegration of conventional solid dosage forms or chewable solid dosage forms (i.e., tablets or capsules) which are intended to be swallowed immediately after administration. ODT compositions in addition to a therapeutically effective amount of lamotrigine can contain a taste masking ingredient as well as other ingredients such as a disintegrant, a sugar alcohol, a saccharide, or a mixture thereof, a water soluble binder, a wax, flavoring, etc.

Figure 3:
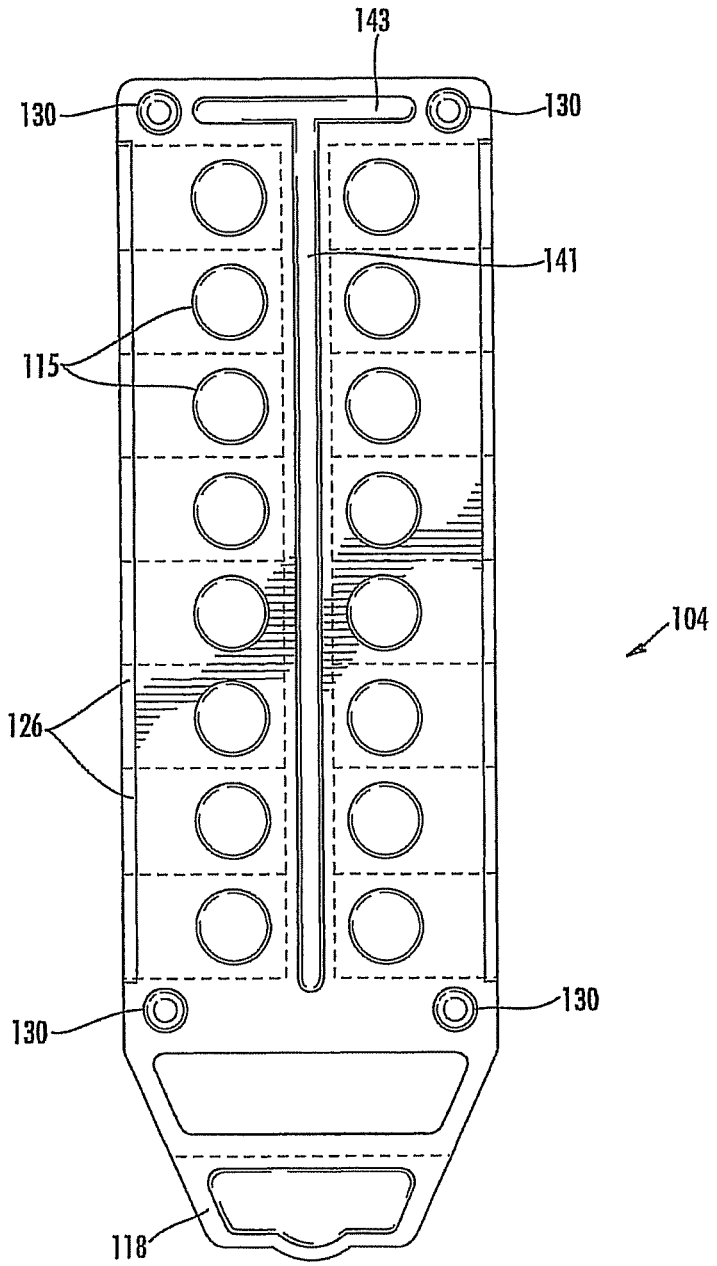
FIG. 3 shows a plan view of a first blister strip according to the subject matter disclosed herein.
Figure 4:
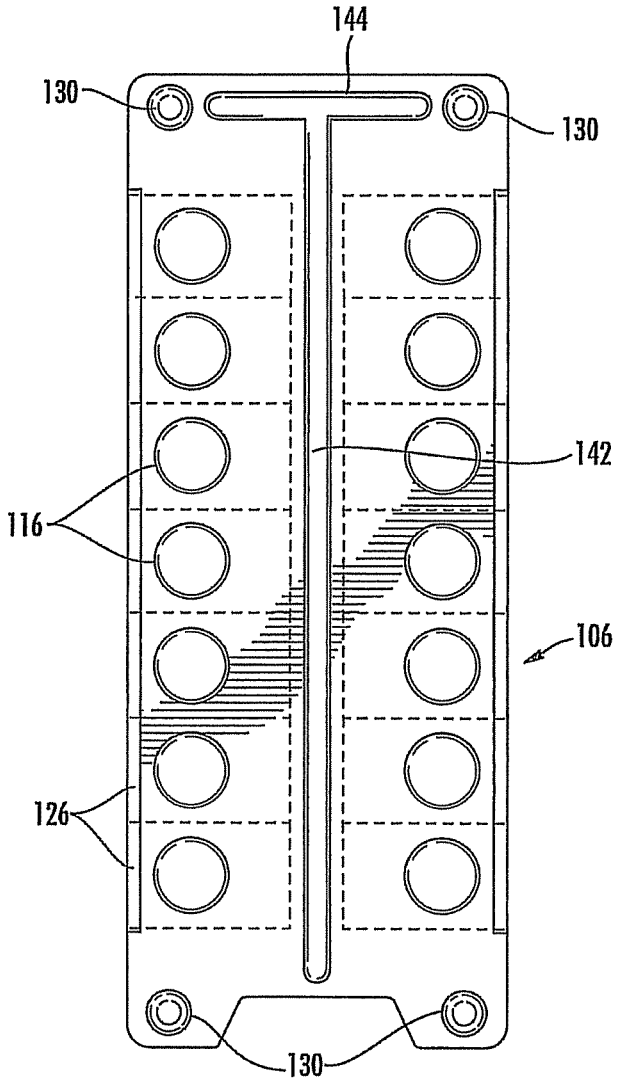
FIG. 4 shows a plan view of a second blister strip according to the subject matter disclosed herein.

As can be seen in FIG. 2, package 100 can include a first blister strip 104 and a second blister strip 106. FIGS. 3 and 4 provide detailed views of first blister strip 104 and second blister strip 106, respectively. As can be seen in these figures, first blister strip 104 can include a plastic sheet 109 having a first surface 111 and an opposing second surface 113. A plurality of recesses 115 can be formed in plastic sheet 109 projecting from first surface 111. Similarly, second blister strip 106 can include a plastic sheet 110 having a first surface 112 and an opposing second surface 114, with a plurality of recesses 116 being formed in plastic sheet 110 projecting from first surface 112. In addition, either or both of first blister strip 104 and/or second blister strip 106 can include a locking flap 118, shown in the Figures on first blister strip 104, which can be used to restrict the movement of package 100 with respect to another protective layer as described below.

Each of blister strips 104 and 106 can further include a backing layer 120 that can be secured to second surfaces 113 and 114 for covering the plurality of recesses 115 and 116. Each of recesses 115 and 116 can be adapted to receive one or more tablets 102. As is illustrated in FIGS. 3 and 4, each of recesses 115 and 116 can have the same size and shape to store identical tablets 102. For instance, such a configuration would be useful to provide identical daily doses of a medication. In an alternative configuration, depicted in FIG. 5, one or both of plastic sheets 109 and 110 can include a variety of different recesses 115 and 116 for storing multiple kinds of tablets. This alternative configuration can be used, for instance, to administer multiple kinds of medication in a prescribed schedule. For example, the configuration shown in FIG. 5 can be used to package together one medication intended to be taken in the morning and a different medication intended to be taken in the evening.

Regardless of the specific product or products to be contained in blister package 100, package 100 can include a plurality of support posts 130 for securing first blister strip 104 to second blister strip 106. Support posts 130 can be features built onto one or both of first surfaces 111 and 112 of plastic sheets 109 and 110 of the blister strips. In this arrangement, blister strips 104 and 106 can be secured together with first surface 111 of first blister strip 104 facing first surface 112 of second blister strip 106 (i.e., side-facing configuration). Support posts 130 can be either releasably or fixedly secured to blister strips 104 and 106. Alternatively, support posts 130 can be discrete pieces of an adhesive material (e.g., glue posts) that can be used to secure first blister strip 104 and second blister strip 106 together. It is believed that embodiments in which first and second blister strips 104 and 106 are fixedly secured together are more tailored to preventing a consumer from pressing against the tops of recesses 115 or 116 because the tops of recesses 115 or 116 of each blister strip are permanently concealed beneath the opposing blister strip. As a result, when blister strips 104 and 106 are positioned with their respective first surfaces 111 and 112 facing each other as is shown in FIG. 1, it is not necessarily obvious where the consumer would need to push to transmit a force through one blister strip to a recess 115 or 116 in the opposing blister strip.

Figure 5:
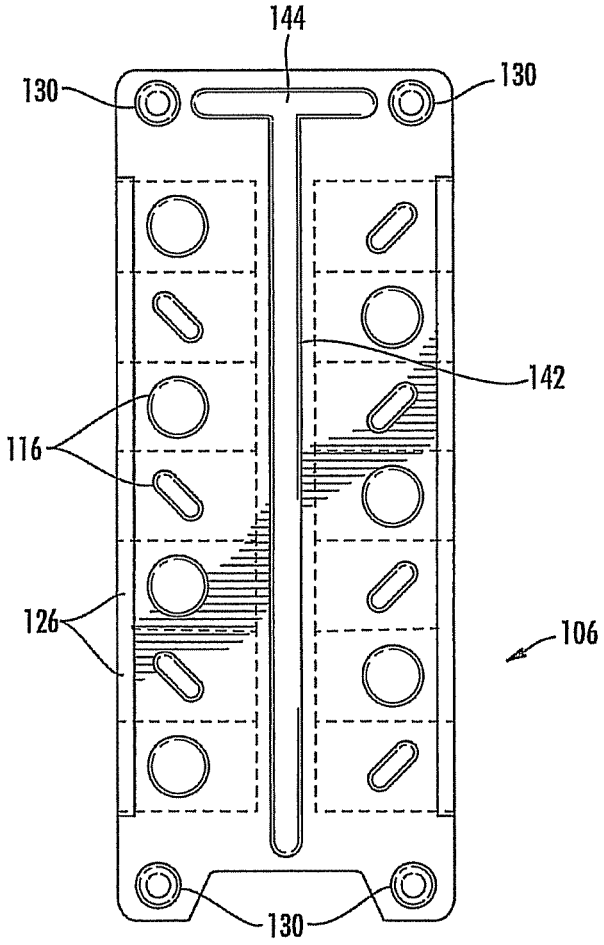
FIG. 5 shows a plan view of a second blister strip according to another embodiment of the subject matter disclosed herein.

Package 100 can further include one or more spacer elements 132 extending from one or both of first blister strip 104 or second blister strip 106 towards the other blister strip to further prevent a consumer from trying to forcefully push tablet 102 through backing layer 120. Spacer element 132 can extend between two or more of the plurality of recesses 115 and 116 for maintaining blister strips 104 and 106 in a spaced-apart configuration. For example, as depicted in FIGS. 3 through 5, the plurality of recesses 115 and 116 can be formed in plastic sheets 109 and 110 in two columns, with the first column of recesses and a second column of recesses being separated by spacer element 132.

As noted above, spacer element 132 can function to maintain blister strips 104 and 106 in a spaced-apart configuration. Support posts 130 can also be sized to maintain this spacing between blister strips 104 and 106. The spacing created does not need to be significant, but merely needs to be sufficient to help prevent any force applied to the back of one blister strip from being transmitted to one of recesses 115 or 116 of the opposing blister strip. For instance, the height of spacer element 132 and/or support posts 130 can be sized to at least be greater than the depth of any of the plurality of recesses 115 or 116 in first blister strip 104 and second blister strip 106. Where recesses 115 and/or 116 have different shapes to accommodate multiple kinds of tablets and thus have different depths, the height of spacer element 132 and/or support posts 130 can be sized to be greater than the depth of the largest (i.e. deepest) recesses 115 and 116.

In this arrangement, any force applied to a second surface 113 or 114 of one of blister strips 104 or 106 will not be fully transmitted to one of recesses 115 or 116 in the opposing blister strip. Rather, at least some of the force applied can be transmitted to spacer element 132 and/or support posts 130. As a result, the amount of force received by tablet 102 can be greatly reduced, and a consumer can be deterred from trying to push tablet 102 out through backing layer 120. In addition, spacer element 132 can comprise a substantially rigid strip of material to prevent plastic sheets 109 and 110 from flexing under the application of a force. The added rigidity created by such a spacer element 132 can further convey that package 100 is not intended to be operated as a push-through blister package, which must inherently be easily deformable.

To maintain space between blister strips 104 and 106, spacer element 132 can be provided on package 100 in a variety of forms. In one embodiment, spacer element 132 can be a single strip secured to either or both of first blister strip 104 and second blister strip 106. In an alternative embodiment, spacer element 132 can be formed from some combination of a first raised feature 141 on first surface 111 of first blister strip 104 and a first raised feature 142 on first surface 112 of second blister strip 106. In this configuration, first raised feature 141 of first blister strip 104 can be substantially aligned with first raised feature 142 of second blister strip 106.

Additionally, spacer element 132 can be incorporated not only to ensure that sufficient spacing is maintained between first and second blister strips 104 and 106, but it can also serve to deter the consumer from reaching between the two blister strips 104 and 106. In this regard, spacer element 132 can include a first spacer section 134 and a second spacer section 136, with first spacer section 134 primarily serving to maintain space between blister strips as described above and second spacer section 136 deterring the consumer from reaching between the blister strips. In one arrangement, first spacer section 134 and second spacer section 136 can be formed or positioned between first and second blister strips 104 and 106 such that they are substantially perpendicular to each other. For instance, first spacer section 134 can be provided as a strip disposed longitudinally between first and second blister strips 104 and 106, while second spacer section 136 can be disposed laterally between the edges of package 100. In addition, at least a portion of spacer element 132 can substantially fill the space between first surface 111 of first blister strip 104 and first surface 112 of second blister strip 106 along at least one edge of the package. Alternatively, spacer element 132 can be provided between first surface 111 of first blister strip 104 and first surface 112 of second blister strip 106 along the entire periphery of package 100. In either arrangement, by substantially filling the space between the blister strips 104 and 106, this design effectively creates a barrier to prevent a consumer from reaching between the blister strips 104 and 106 and either pressing on one of recesses 115 or 116 or prying the blister strips 104 and 106 apart.

Additionally, just as it is noted that spacer element 132 can generally be provided either as a unitary spacer or a pair of complementary raised features on either blister strip, second spacer section 136 (i.e., the barrier section) can likewise be provided in a variety of forms. For instance, spacer element 132 can include a second raised feature 143 on first surface 111 of first blister strip 104 substantially parallel to one end of first blister strip 104 and a second raised feature 144 on first surface 112 of second blister strip 106 substantially parallel to one end of second blister strip 106. Second raised feature 143 of first blister strip 104 can be substantially aligned with second raised feature 144 of second blister strip 106, the combination of the two elements thereby serving as second spacer section 136.

Figure 6A:
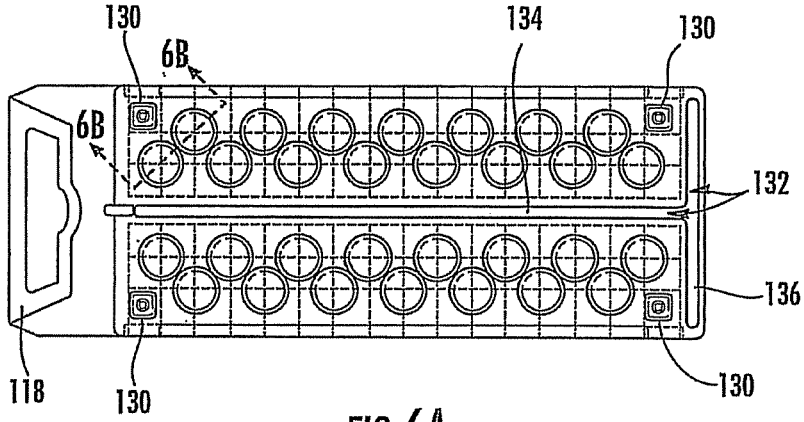
FIG. 6A shows a plan view of two blister strips secured together according to the subject matter disclosed herein.
Figure 6B:
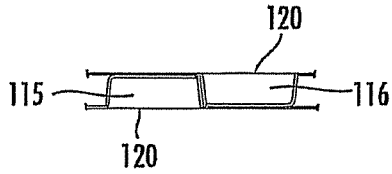
FIG. 6B shows a cross-sectional view of two individual blisters from opposing blister strips nested together according to the embodiment of the subject matter disclosed herein illustrated in FIG. 6A.
Figure 7:
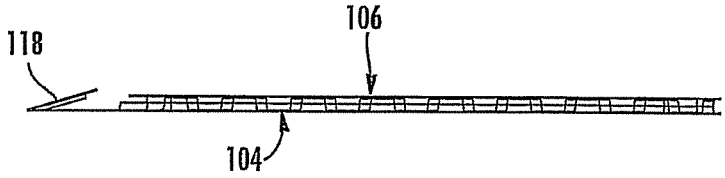
FIG. 7 shows a side view of a blister package according to the subject matter disclosed herein.

Advantageously, as is shown in FIGS. 6A and 6B, the plurality of recesses 116 formed in second blister strip 106 can be offset with respect to recesses 115 formed in first blister strip 104 such that when first blister strip 104 and second blister strip 106 are secured together, recesses 116 of second blister strip 106 nest between recesses 115 of first blister strip 104. Of course, recesses from one blister strip need not be sized so that they interlock or even touch recesses from the other blister strip. It is advantageous, however, if recesses 115 and 116 are positioned such that when first blister strip 104 and second blister strip 106 are secured together, the total height of package 100 is less than the combination of the heights of first blister strip 104 and second blister strip 106. Stated otherwise, as is shown in FIG. 7, the total height of package 100 can be substantially the same as the height of a single blister strip. This low profile design provides that package 100 can be used to store and dispense a larger number of tablets 102 in a relatively small container. In addition, as is discussed above, the staggered layout of recesses 115 and 116 relative to each other helps to effectively shield a consumer from trying to push on any of recesses 115 or 116 to eject a tablet 102.

Figure 8A:
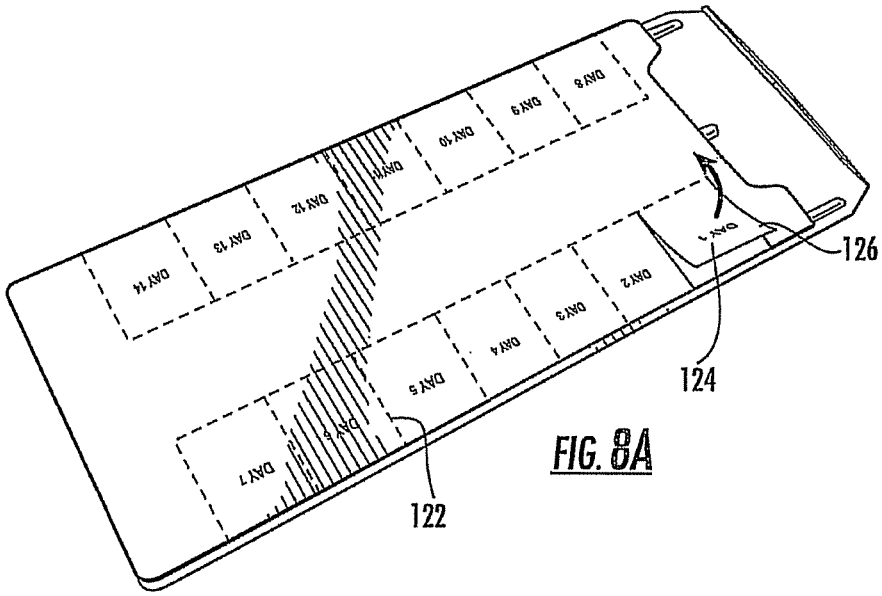
FIGS. 8A-C show perspective views of steps for removing a product from a blister in a blister package according to the subject matter disclosed herein.
Figure 8B:
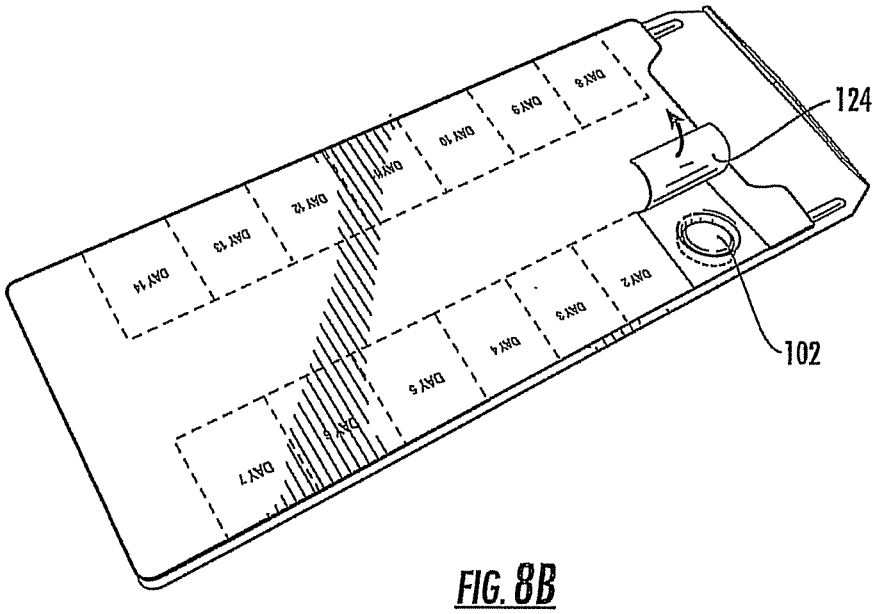
Figure 8C:
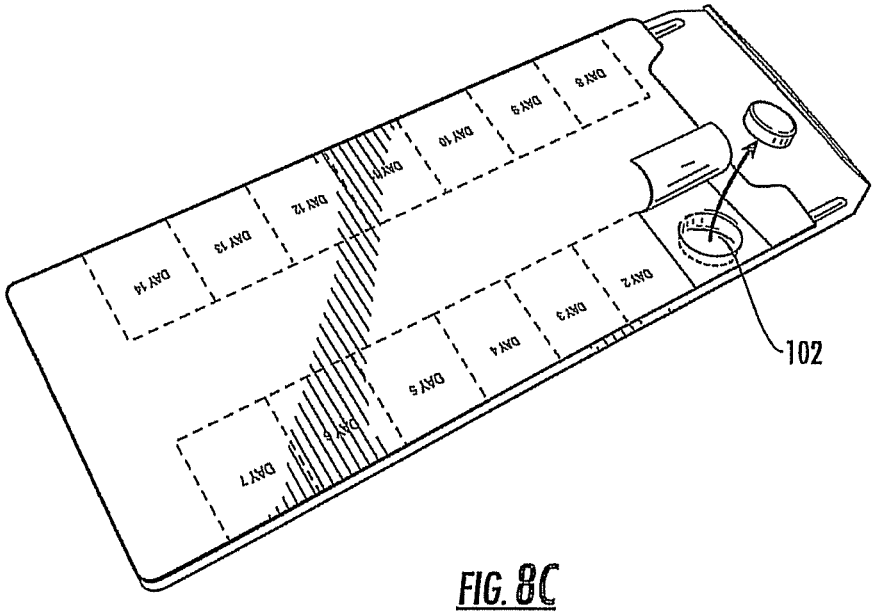

Because the design of package 100 can discourage a consumer from pushing one of tablets 102 through one of backing layers 120, tablets 102 should be extracted by otherwise removing backing layers 120. Accordingly, to facilitate the removal of tablets 102 from recesses 115 or 116, score lines 122 can be formed in backing layers 120 of each of blister strips 104 and 106 about each of the plurality of recesses 115 and 116. Score lines 122 can thereby define a plurality of access panels 124 that can be removed independently to provide access to individual tablets 102. To even further facilitate the removal of tablets 102, each access panel 124 can include at least a portion that is not secured to second surface 113 or 114. This unsecured portion can define a pull tab 126 that can be gripped by a consumer to pull back access panel 124. FIGS. 8A through 8C illustrate steps that can be taken to peel away a backing layer 120 to reveal one of tablets 102. First, pull tab 126 can be gripped by a consumer. By pulling pull tab 126, the consumer can peel access panel 124 away from plastic sheet 109 or 110 and expose tablet 102. Finally, the consumer can pull tablet 102 out from recess 115 or 116 or invert package 100 to allow tablet 102 to simply drop out of recess 115 or 116.

Figure 9:
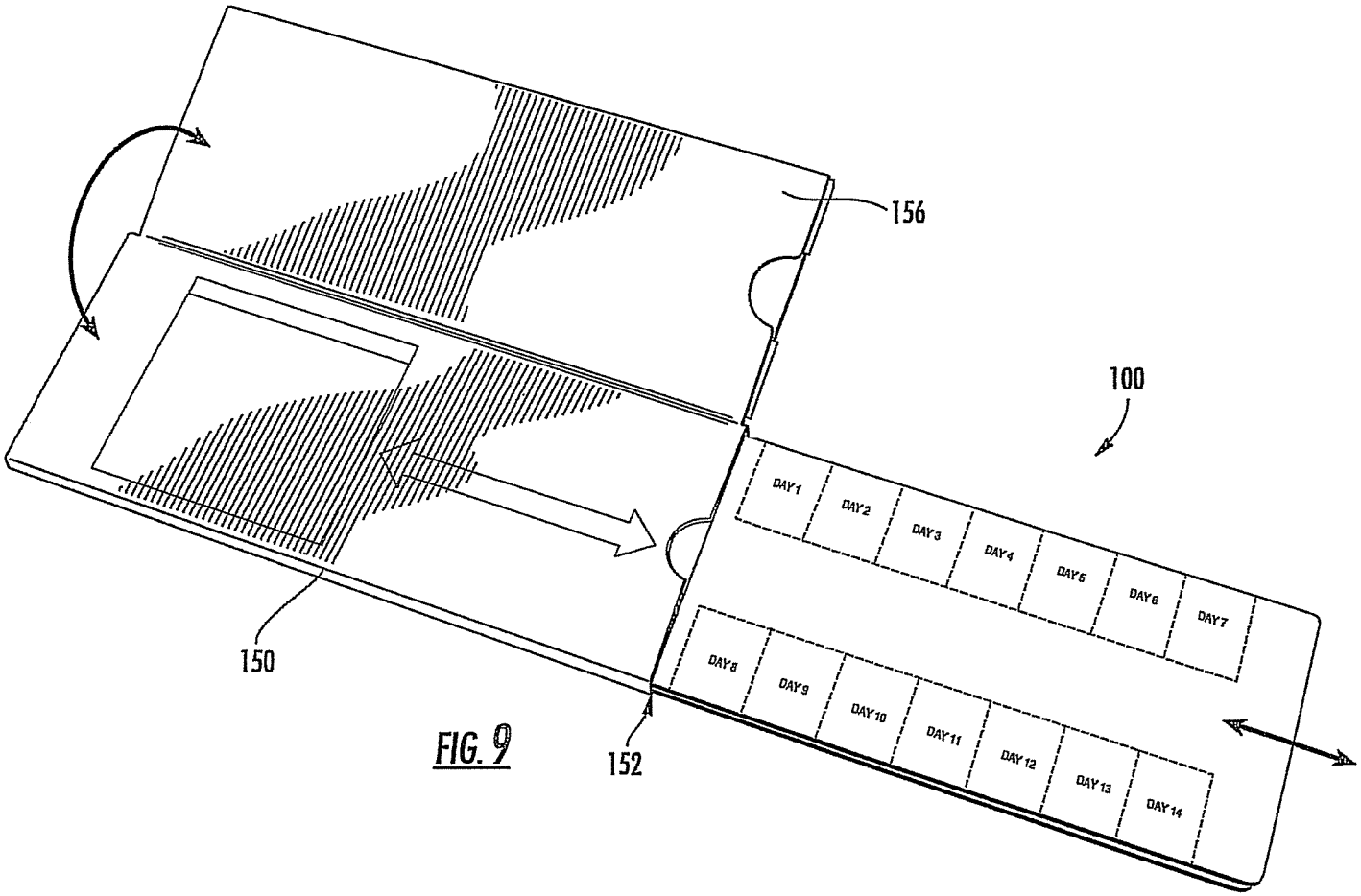
FIG. 9 shows a perspective view of a blister package being inserted into a protective sleeve according to the subject matter disclosed herein.
Figure 10:
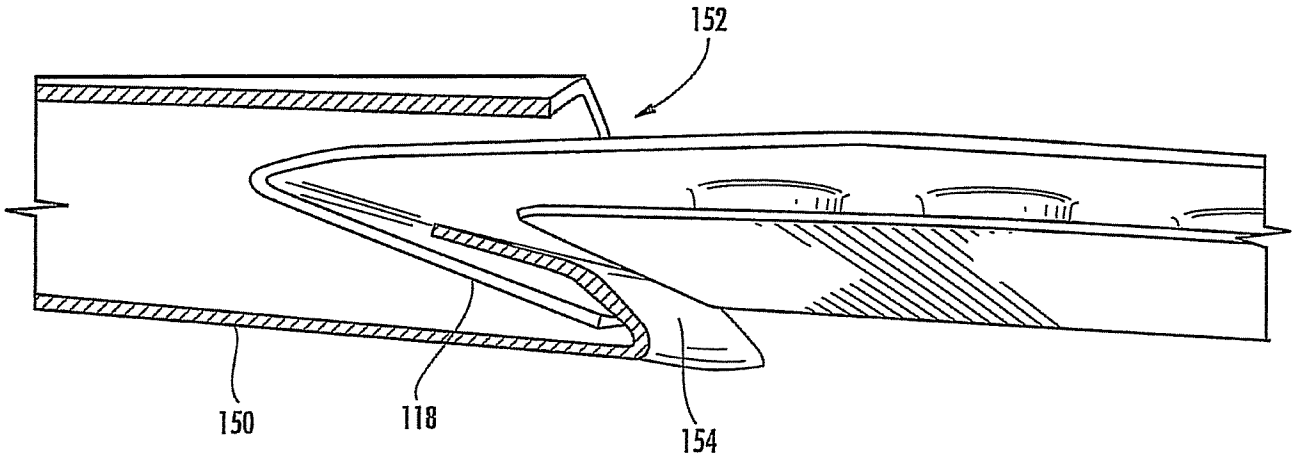
FIG. 10 shows a side view of the blister package inserted into sleeve according to the embodiment of the subject matter disclosed herein illustrated in FIG. 9.

Although package 100 as disclosed hereinabove provides an effective solution for storing and distributing soft or breakable tablets such as tablets 102, it may be desirable to provide additional layers of protection to deter inadvertent or unwanted access to tablets 102. For instance, FIG. 9 illustrates package 100 including one example of a sleeve 150 for receiving blister strips 104 and 106. Sleeve 150 can be open at one end 152 to allow blister strips 104 and 106 to slide in or out of sleeve 150. In addition, sleeve 150 can include a locking tab 154 for releasably retaining blister strips 104 and 106 within sleeve 150. As is depicted in FIG. 10, locking tab 154 can engage a corresponding flap 118 on first blister strip 104 to prevent blister strips 104 and 106 from sliding completely out of sleeve 150. In one embodiment, sleeve 150 can be a commercially-available Dosepak® unit-dose medication packaging sleeve made by MeadWestvaco Corporation.

Sleeve 150 can work in combination with other elements of package 100 to prevent unwanted access to tablets 102. For example, as discussed above spacer element 132 can comprise first and second spacer sections 134 and 136, with second spacer section 136 serving as a barrier section positioned at one end of package 100. In this arrangement, package 100 can be positioned within sleeve 150 with second spacer section 136 positioned at the end of package 100 corresponding to open end 152 of sleeve 150 such that second spacer section 136 blocks access to the plurality of recesses 115 and 116.

Sleeve 150 can also be used to store information about the product contained therein. For instance, as is depicted in FIG. 9, an information flap 156 can be attached to sleeve 150. Information flap 156 can directions for using package 100, drug information, warnings, advertisements, or any other information the consumer would find useful. By attaching this information to sleeve 150, the consumer can always have access to the information when retrieving a tablet 102 from package 100. Alternatively, rather than an information flap, a second package and sleeve assembly can be coupled to sleeve 150.

Still referring to the above-mentioned figures, and in a more specific configuration, the presently disclosed subject matter likewise can provide a package 100 for soft tablets 102. Package 100 can include a first blister strip 104, first blister 104 strip having a plastic sheet 109 with a first surface 111 and an opposing second surface 113, a plurality of recesses 115 projecting from first surface 111, a backing layer 120 on second surface 113 and covering the plurality of recesses 115, a first raised feature 141 on first surface 111 extending between two or more of the plurality of recesses 115, a second raised feature 143 on first surface 111 at one end of blister strip 104, and a plurality of support posts 130 spaced about first surface 111.

In addition, package 100 can include a second blister strip 106 positioned facing first blister strip 104. Second blister strip 106 can similarly include a plastic sheet 110 having a first surface 112 and an opposing second surface 114, first surface 112 facing first surface 111 of first blister strip 104. A plurality of recesses 116 can project from first surface 112, recesses 116 arranged on first surface 112 such that they are offset from the plurality of recesses 115 of first blister strip 104. A backing layer 120 can be provided on second surface 114 covering the plurality of recesses 116. Second blister strip 106 can further include a first raised feature 142 on first surface 112 extending between two or more of the plurality of recesses 116, first raised feature 142 being substantially aligned with first raised feature 141 of first blister strip 104 to form a first spacer section 134. A second raised feature 144 can be provided on first surface 112 at one end of blister strip 106, second raised feature 144 being substantially aligned with second raised 143 feature of first blister strip 104 to form a second spacer section 136. Similar to the embodiment described above, first spacer section 134 can serve to maintain first and second blister strips 104 and 106 in a spaced-apart configuration, and second spacer section 136 can be useful as a barrier to block access to the space between the blister strips. Finally, a plurality of support posts 130 can be spaced about first surface 112 and secured to the plurality of support posts 130 of first blister strip 104. Each of recesses 115 and 116 in both first blister strip 104 and second blister strip 106 can be adapted to receive tablet 102.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A package for soft tablets comprising:
- a first blister strip comprising:
  - a plastic sheet having a first surface and an opposing second surface;
  - a plurality of recesses projecting from the first surface, each of the recesses adapted to receive a soft tablet;
  - a backing layer on the second surface and covering the plurality of recesses;
  - a first raised feature on the first surface extending between two or more of the plurality of recesses;
  - a second raised feature on the first surface at one end of the blister strip; and
  - a plurality of support posts spaced about the first surface;
- a second blister strip positioned facing the first blister strip, the second blister strip comprising:
  - a plastic sheet having a first surface and an opposing second surface, the first surface facing the first surface of the first blister strip;
  - a plurality of recesses projecting from the first surface, the recesses arranged on the first surface such that they are offset from the plurality of recesses of the first blister strip, each of the recesses adapted to receive a soft tablet;
  - a backing layer on the second surface and covering the plurality of recesses;
  - a first raised feature on the first surface extending between two or more of the plurality of recesses, the first raised feature being substantially aligned with the first raised feature of the first blister strip to form a first spacer section;
  - a second raised feature on the first surface at one end of the blister strip, the second raised feature being substantially aligned with the second raised feature of the first blister strip to form a second spacer section; and
  - a plurality of support posts spaced about the first surface secured to the plurality of support posts of the first blister strip.

2. A package for tablets, the package comprising:
- a first blister strip and a second blister strip, each of the blister strips having:
  - a plastic sheet having a first surface and an opposing second surface;
  - a plurality of recesses formed in the plastic sheet and projecting from the first surface, each of the recesses adapted to receive a tablet; and
  - a backing layer secured to the second surface for covering the plurality of recesses;
- a plurality of support posts securing the first blister strip to the second blister strip; and
- a spacer element extending from one of the first blister strip or the second blister strip towards the other of the first blister strip or the second blister strip, the spacer element extending between two or more of the plurality of recesses for maintaining the blister strips in a spaced-apart configuration, wherein the spacer element comprises:
- a first raised feature on the first surface of the first blister strip; and
- a first raised feature on the first surface of the second blister strip;
- wherein the first raised feature of the first blister strip is substantially aligned with the first raised feature of the second blister strip;
- wherein, when the plurality of support posts secure the first surface of the first blister strip to the first surface of the second blister strip, the recesses formed in the second blister strip are offset with respect to the recesses formed in the first blister strip and the recesses of the second blister strip nest between the recesses of the first blister strip.

3. The package of claim 2, wherein the backing layer of each of the blister strips comprises score lines about each of the plurality of recesses, the score lines defining an access panel.

4. The package of claim 3, wherein at least an unsecured portion of the access panel is not secured to the second surface, and wherein the unsecured portion defines a pull tab.

5. The package of claim 2, wherein the plurality of recesses comprises a first column of recesses and a second column of recesses, the first column and the second column being separated by the spacer element.

6. The package of claim 2, wherein at least a portion of the spacer element substantially fills the space between the first surface of the first blister strip and the first surface of the second blister strip along at least one edge of the package.

7. The package of claim 2, wherein the spacer element comprises a first spacer section and a second spacer section, the first spacer section and the second spacer section being substantially perpendicular to each other.

8. The package of claim 2, wherein the height of the spacer element is greater than the depth of any of the plurality of recesses in the first blister strip and the second blister strip.

9. The package of claim 2, wherein the spacer element comprises a substantially rigid strip.

10. The package of claim 2, comprising a sleeve for receiving the blister strips, the sleeve being open at one end.

11. A package for tablets, the package comprising:

a first blister strip and a second blister strip, each of the blister strips having:

a plastic sheet having a first surface and an opposing second surface;

a plurality of recesses formed in the plastic sheet and projecting from the first surface, each of the recesses adapted to receive a tablet; and a backing layer secured to the second surface for covering the plurality of recesses;

a plurality of support posts securing the first blister strip to the second blister strip; and a spacer element extending from one of the first blister strip or the second blister strip towards the other of the first blister strip or the second blister strip, the spacer element extending between two or more of the plurality of recesses for maintaining the blister strips in a spaced-apart configuration, wherein the spacer element comprises:

(1) a first raised feature on the first surface of the first blister strip, (2) a first raised feature on the first surface of the second blister strip, wherein the first raised feature of the first blister strip is substantially aligned with the first raised feature of the second blister strip, (3) a second raised feature on the first surface of the first blister strip substantially parallel to one end of the first blister strip, and (4) a second raised feature on the first suface of the second blister strip substantially parallel to one end of the second blister strip, wherein the second raised feature of the first blister strip is substantially aligned with the second raised feature of the second blister strip, wherein, when the plurality of support posts secure the first surface of the first blister strip to the first surface of the second blister strip, the recesses formed in the second blister strip are offset with respect to the recesses formed in the first blister strip and the recesses of the second blister strip nest between the recesses of the first blister strip.

12. The package of claim 11, wherein the backing layer of each of the blister strips comprises score lines about each of the plurality of recesses, the score lines defining an access panel.

13. The package of claim 12, wherein at least an unsecured portion of the access panel is not secured to the second surface, and wherein the unsecured portion defines a pull tab.

14. The package of claim 11, wherein the plurality of recesses comprises a first column of recesses and a second column of recesses, the first column and the second column being separated by the spacer element.

15. The package of claim 11, wherein at least a portion of the spacer element substantially fills the space between the first surface of the first blister strip and the first surface of the second blister strip along at least one edge of the package.

16. The package of claim 11, wherein the spacer element comprises a first spacer section and a second spacer section, the first spacer section and the second spacer section being substantially perpendicular to each other.

17. The package of claim 11, comprising a sleeve for receiving the blister strips, the sleeve being open at one end.

18. A package for tablets, the package comprising:

a first blister strip and a second blister strip, each of the blister strips having:

a plastic sheet having a first surface and an opposing second surface;

a plurality of recesses formed in the plastic sheet and projecting from the first surface, each of the recesses adapted to receive a tablet; and a backing layer secured to the second surface for covering the plurality of recesses;

a plurality of support posts securing the first blister strip to the second blister strip;

a sleeve for receiving the blister strips, the sleeve being open at one end; and a spacer element extending from one of the first blister strip or the second blister strip towards the other of the first blister strip or the second blister strip, the spacer element extending between two or more of the plurality of recesses for maintaining the blister strips in a spaced-apart configuration, wherein the spacer element comprises a barrier section positioned at one end of the package, wherein the blister strips can be positioned within the sleeve with the barrier section positioned at one end of the blister strips corresponding to the open end of the sleeve such that the barrier section blocks access to the plurality of recesses;

wherein, when the plurality of support posts secure the first surface of the first blister strip to the first surface of the second blister strip, the recesses formed in the second blister strip are offset with respect to the recesses formed in the first blister strip and the recesses of the second blister strip nest between the recesses of the first blister strip.

19. The package of claim 18, wherein the backing layer of each of the blister strips comprises score lines about each of the plurality of recesses, the score lines defining an access panel.

20. The package of claim 19, wherein at least an unsecured portion of the access panel is not secured to the second surface, and wherein the unsecured portion defines a pull tab.

21. The package of claim 18, wherein the plurality of recesses comprises a first column of recesses and a second column of recesses, the first column and the second column being separated by the spacer element.

22. The package of claim 18, wherein at least a portion of the spacer element substantially fills the space between the first surface of the first blister strip and the first surface of the second blister strip along at least one edge of the package.

23. The package of claim 18, wherein the spacer element comprises a first spacer section and a second spacer section, the first spacer section and the second spacer section being substantially perpendicular to each other.

* * * * *